US009658552B1

(12) United States Patent
Matsumoto et al.

(10) Patent No.: US 9,658,552 B1
(45) Date of Patent: May 23, 2017

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Akira Matsumoto, Kanagawa (JP); Masaki Iwase, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/093,274

(22) Filed: Apr. 7, 2016

(30) Foreign Application Priority Data

Dec. 24, 2015 (JP) ..... 2015-252033

(51) Int. Cl.
*G03G 9/09* (2006.01)
*G03G 9/087* (2006.01)

(52) U.S. Cl.
CPC ..... *G03G 9/08791* (2013.01); *G03G 9/0924* (2013.01); *G03G 2215/066* (2013.01)

(58) Field of Classification Search
CPC ..... G03G 9/09733; G03G 9/0924
See application file for complete search history.

(56) References Cited

U.S. PATENT DOCUMENTS

2013/0171554 A1* 7/2013 Yamashita ..... G03G 9/0906 430/108.21

FOREIGN PATENT DOCUMENTS

JP 2013-109176 A 6/2013

* cited by examiner

*Primary Examiner* — Peter Vajda
(74) *Attorney, Agent, or Firm* — Oliff PLC

(57) ABSTRACT

An electrostatic charge image developing toner includes toner particles including a binder resin, a cyano pigment containing cyano group (—CN) in a molecular structure, and a benzonitrile compound which has a structure in which at least one cyano group (—CN) is present on a benzene ring as a substituent and has a molecular weight equal to or smaller than 300, wherein a content of the benzonitrile compound is from 1 ppm to 500 ppm with respect to the total amount of the toner particles.

13 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-252033 filed Dec. 24, 2015.

BACKGROUND

1. Technical Field

The present invention relates to an electrostatic charge image developing toner, an electrostatic charge image developer, and a toner cartridge.

2. Related Art

In recent years, recording media including images formed thereon by electrophotography have been used in various fields, and images are also formed on recording media such as cardboard and the molded recording media are used, in the field of packaging (packaging material).

Herein, in the related art, the recording media including images formed thereon by electrophotography may be used in a folded state after the formation of images. However, a phenomenon (deletion) in which images are peeled off in a folded portion may occur and improvement in strength with respect to the folding of images has been required.

SUMMARY

According to an aspect of the invention, there is provided an electrostatic charge image developing toner including:

toner particles including a binder resin, a cyano pigment containing cyano group (—CN) in a molecular structure, and a benzonitrile compound which has a structure in which at least one cyano group (—CN) is present on a benzene ring as a substituent and has a molecular weight equal to or smaller than 300, wherein a content of the benzonitrile compound is from 1 ppm to 500 ppm with respect to the total amount of the toner particles.

BRIEF DESCRIPTION OF THE DRAWINGS

Exemplary embodiments of the present invention will be described in detail based on the following figures, wherein.

DETAILED DESCRIPTION

Figure 1:
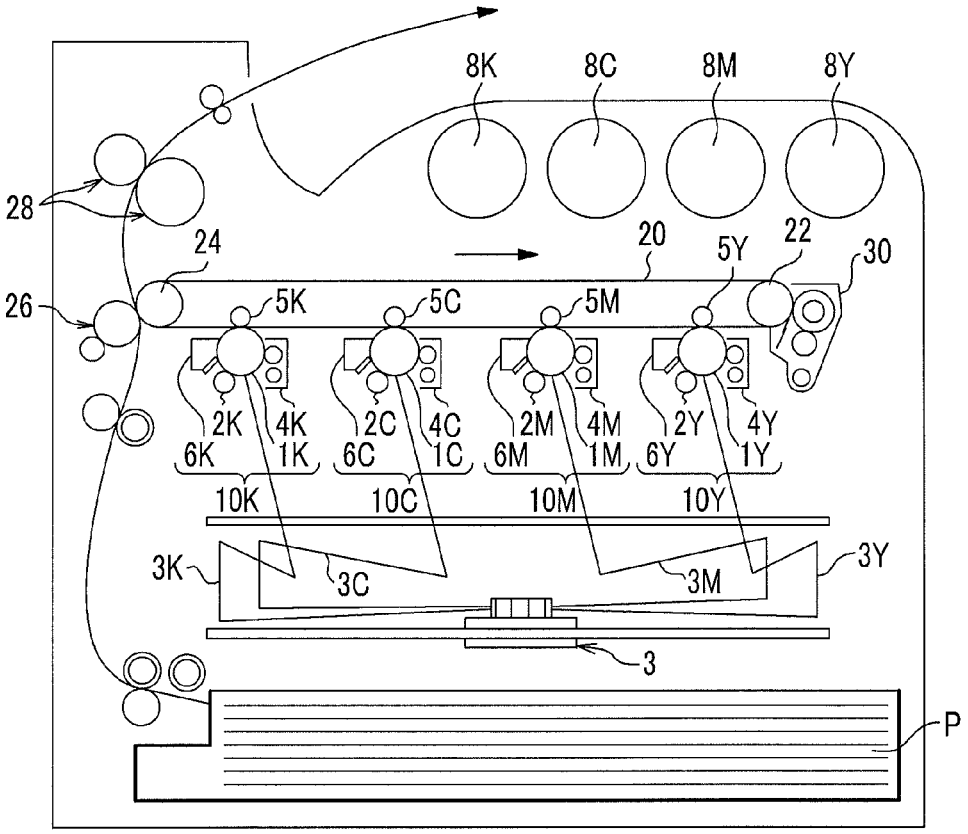
FIG. 1 is a schematic configuration diagram showing an example of an image forming apparatus according to the exemplary embodiment.

Hereinafter, exemplary embodiments which are examples of the invention will be described in detail.

Electrostatic Charge Image Developing Toner

An electrostatic charge image developing toner according to the exemplary embodiment (hereinafter, also simply referred to as a "toner") contains toner particles.

The toner particle contains a binder resin, a cyano pigment containing a cyano group (—CN) in a molecular structure (hereinafter, also referred to as a "specific cyano pigment"), and a benzonitrile compound having a structure in which at least one cyano group (—CN) is present on a benzene ring as a substituent and a molecular weight equal to or smaller than 300 (hereinafter, also referred to as a "specific benzonitrile compound"). The content of the benzonitrile compound is from 1 ppm to 500 ppm with respect to the total amount of the toner particles.

In the related art, recording media including images formed thereon by electrophotography may be used in a folded state after the formation of images according to the purpose thereof. For example, the recording media are used for the purpose of a package (packaging material) which is molded by folding a recording medium after forming an image on the recording medium such as cardboard by electrophotography.

However, a phenomenon (deletion) in which images are peeled off in a folded portion may occur and particularly easily occur in a half-tone image of the image in which gaps between toner particles and other toner particles easily open. Therefore, it is required that the strength with respect to the folding of the image is further improved.

With respect to this, according to the toner of the exemplary embodiment, an image having excellent strength with respect to the folding may be formed. Reasons for exhibiting this effect are assumed as follows.

When the folded portion of the image where the peeling (deletion) of the image occurs is observed, it is found that the peeling of the image occurs in an interface between an aggregate obtained by the aggregation of pigment and the binder resin. Accordingly, the peeling (deletion) of the image is prevented and the strength with respect to the folding is improved by improving the dispersibility of the pigment in the toner particles and preventing formation of an aggregate of the pigment.

Herein, the toner according to the exemplary embodiment contains a specific benzonitrile compound and a specific cyano pigment in the toner particle. Since the benzonitrile compound has a high polarity due to the presence of a cyano group (—CN) and a low molecular weight as a molecular weight equal to or smaller than 300, the benzonitrile compound repel each other in the binder resin present in the toner particle and are dispersed and present in an approximately uniform state. Since the cyano pigment includes a cyano group (—CN) in the same manner as in the benzonitrile compound, the cyano pigment and the benzonitrile compound are easily attracted to each other due to an interaction, and therefore, the cyano pigment are also dispersed and present in an approximately uniform state in the binder resin present in the toner particle. As a result, the formation of the aggregate of the pigment is prevented by improving dispersibility of the cyano pigment and the peeling (deletion) of the image in an interface between the aggregate and the binder resin may be prevented.

Content of Benzonitrile Compound

In the exemplary embodiment, the content of the benzonitrile compound is from 1 ppm to 500 ppm with respect to the total amount of the toner particles. The content is preferably from 50 ppm to 400 ppm and more preferably from 100 ppm to 300 ppm. In this specification, "ppm" representing the content of the benzonitrile compound is based on weight.

When the content of the benzonitrile compound in the toner particles is smaller than 1 ppm, the dispersibility of the cyano pigment is decreased and the strength with respect to the folding of the image is not obtained. Meanwhile, when the content exceeds 500 ppm, electric charge leakage of the toner is increased and transfer performance of the image is decreased.

The content of the benzonitrile compound in the toner particles is determined by a calibration curve of the benzonitrile compound which is measured by liquid chromatography (LC-UV) in advance, after identifying the liquid chromatography by chemical analysis. Specifically, the content thereof is determined by weighing 0.05 g of the toner, performing ultrasonic extraction for 30 minutes after adding tetrahydrofuran, collecting an extract, and setting a solution, the amount of which is accurately 20 mL, as a sample solution using acetonitrile, and performing measurement by liquid chromatography (LC-UV).

Then, each component configuring the toner according to the exemplary embodiment will be described.

The toner according to the exemplary embodiment contains the toner particles, and if necessary, an external additive.

Toner Particle

The toner particle, for example, contains the binder resin, the cyano pigment, the benzonitrile compound, and if necessary, a release agent, and other additives.

Cyano Pigment

The toner particle contains a specific cyano pigment containing a cyano group (—CN) in a molecular structure.

Examples of the specific cyano pigment include C.I. Pigment Yellow 185, C.I. Pigment Red 260, C.I. Pigment Orange 71, and C.I. Pigment Orange 66 representing the following structure (herein, "C.I." represents Colour Index).

C.I. Pigment Yellow 185

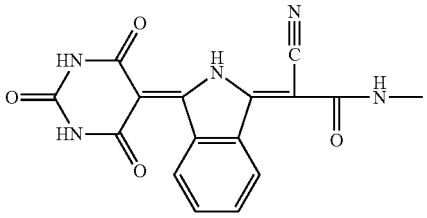

C.I. Pigment Red 260

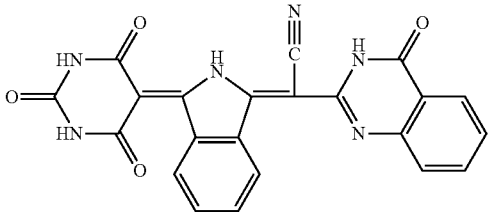

C.I. Pigment Orange 71

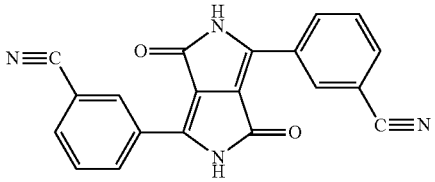

C.I. Pigment Orange 66

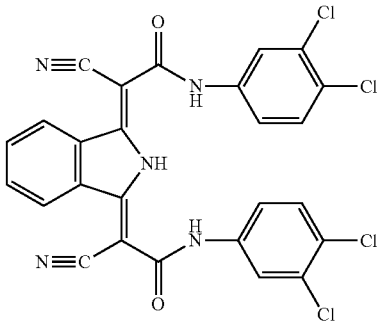

The specific cyano pigment may be used alone or in combination of two or more kinds thereof.

A molecular weight of the specific cyano pigment is not particularly limited and generally exceeds 300.

In the exemplary embodiment, the toner particle may contain a colorant other than the specific cyano pigment. The content of the entire colorant (content of the entire colorant including the specific cyano pigment and other colorants) is preferably from 1% by weight to 30% by weight, more preferably from 1% by weight to 20% by weight, and even more preferably from 3% by weight to 15% by weight with respect to the total amount of the toner particles.

When the content of the colorant is equal to or greater than the lower limit value described above, the required density of the toner is applied. Meanwhile, when the content thereof is equal to or smaller than the upper limit value, the amount of the colorant present in the surface of the toner is prevented and a decrease in charging properties is prevented.

With respect to the entire colorant contained in the toner particles, the specific cyano pigment is preferably a main component (that is, occupies 50% by weight or more of the entire colorant). In order to further improve the strength with respect to the folding of the image, the specific cyano pigment preferably occupies 80% or more of the entire colorant, more preferably occupies 90% or more of the entire colorant, and particularly preferably occupies 100% by weight of the entire colorant.

Other Colorants

Examples of other colorants include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The other colorants may be used alone or in combination of two or more kinds thereof.

As other colorants, a surface-treated colorant may be used if necessary, and a dispersing agent may be used in combination. In addition, plural kinds may be used in combination as other colorants.

Benzonitrile Compound

In the exemplary embodiment, the specific benzonitrile compound having a structure in which at least one cyano group (—CN) is present on a benzene ring as a substituent and a molecular weight equal to or smaller than 300 is contained in the toner particle.

The specific benzonitrile compound is not particularly limited as long as the requirements described above are satisfied, and a compound represented by the following Formula (N) is used, for example.

Formula (N)

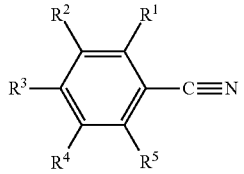

In Formula (N), $R^1$, $R^2$, $R^3$, $R^4$, and $R^5$ each independently represent a hydrogen atom, a cyano group (—CN), a halogen atom (for example, F or Cl), an amino group, or an alkyl group.

The alkyl group represented by $R^1$, $R^2$, $R^3$, $R^4$, and $R^5$ may be substituted with other substituents. Examples of other substituents include a cyano group (—CN), a halogen atom (for example, F or Cl), and an amino group.

The number of cyano groups included in one molecule of the specific benzonitrile compound represented by Formula (N) is preferably two or greater, in order to improve dispersibility of the specific cyano pigment and further improve the strength with respect to the folding of the image, that is, it is preferable that one or more of $R^1$ to $R^5$ of the specific benzonitrile compound represented by Formula (N) is a cyano group or a group including a cyano group (it is more preferable that one or more of $R^1$ to $R^5$ is a cyano group).

A molecular weight of the specific benzonitrile compound is equal to or smaller than 300. The molecular weight thereof is preferably equal to or smaller than 250, more preferably equal to or smaller than 200, and even more preferably equal to or smaller than 150, in order to improve dispersibility of the specific cyano pigment and further improve the strength with respect to the folding of the image. Meanwhile, a lower limit value of the molecular weight is preferably equal to or greater than 110.

Specific examples of the specific benzonitrile compound are not particularly limited as long as the requirements described above are satisfied, and the following compounds are used, for example.

That is, specific examples thereof include phthalonitrile (1,2-dicyano benzene), isophthalonitrile (1,3-dicyano benzene), terephthalonitrile (1,4-dicyano benzene), and benzonitrile (cyano benzene) representing the following structures.

Phthalonitrile

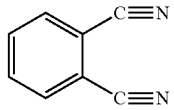

Isophthalonitrile

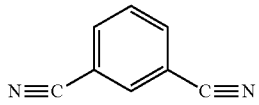

Terephthalonitrile

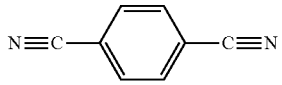

Benzonitrile

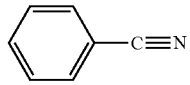

In addition, as an example of the specific benzonitrile compound having a structure in which a substituent other than the cyano group (—CN) is also present on a benzene ring, amino phthalonitrile (4-amino-1,2-dicyano benzene) represented by the following structure is exemplified.

Amino phthalonitrile

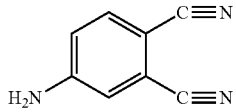

Among these specific examples, phthalonitrile (1,2-dicyano benzene) is particularly preferable.

The content of the specific benzonitrile compound is from 1 ppm to 500 ppm with respect to the total amount of the toner particles and the range described above is more preferable.

The benzonitrile compounds may be used alone or in combination of two or more kinds. In addition, the content at the time of the combination use is from 1 ppm to 500 ppm as the total amount of the benzonitrile compound and the range described above is more preferable.

Binder Resin

Examples of the binder resins include a homopolymer formed of monomers such as styrenes (for example, styrene, p-chlorostyrene, α-methyl styrene, or the like), (meth) acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These binder resins may be used alone or in combination with two or more kinds thereof.

A polyester resin is suitable as the binder resin.

As the polyester resin, a well-known polyester resin is used, for example.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic dials are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the amorphous polyester resin is preferably from 50° C. to 80° C., and more preferably from 50° C. to 65° C.

The glass transition temperature is determined by a DSC curve obtained by differential scanning calorimetry (DSC), and more specifically, is determined by "extrapolation glass transition starting temperature" disclosed in a method of determining the glass transition temperature of JIS K7121-1987 "Testing Methods for Transition Temperature of Plastics".

The weight average molecular weight (Mw) of the amorphous polyester resin is preferably from 5,000 to 1,000,000, and more preferably from 7,000 to 500,000.

The number average molecular weight (Mn) of the amorphous polyester resin is preferably from 2,000 to 100,000.

The molecular weight distribution Mw/Mn of the amorphous polyester resin is preferably from 1.5 to 100, and more preferably from 2 to 60.

The weight average molecular weight and the number average molecular weight are measured by gel permeation chromatography (GPC). The molecular weight measurement by GPC is performed with a THF solvent using GPC • HLC-8120 GPC manufactured by Tosoh Corporation as a measurement device by using a column TSKGEL SUPER HM-M (15 cm) manufactured by Tosoh Corporation. The weight average molecular weight and the number average molecular weight are calculated using a calibration curve of molecular weight created with a monodisperse polystyrene standard sample from results of this measurement.

A known preparing method is applied to prepare the polyester resin. Specific examples thereof include a method of conducting a reaction at a polymerization temperature set to 180° C. to 230° C., if necessary, under reduced pressure in the reaction system, while removing water or an alcohol generated during condensation.

In a case where monomers of the raw materials are not dissolved or compatibilized under a reaction temperature, a high-boiling-point solvent maybe added as a solubilizing agent to dissolve the monomers. In this case, a polycondensation reaction is conducted while distilling away the solubilizing agent. In a case where a monomer having poor compatibility is present in a copolymerization reaction, the monomer having poor compatibility and an acid or an alcohol to be polycondensed with the monomer may be previously condensed and then polycondensed with the major component.

Herein, as the polyester resin, a modified polyester resin is also used, in addition to the unmodified polyester resin described above. The modified polyester resin is a polyester resin in which a bonding group other than an ester bond is present, and a polyester resin in which a resin component other than the polyester resin component is bonded by covalent bonding or ionic bonding. As the modified polyester, a resin including a terminal modified by allowing a reaction between a polyester resin in which a functional group such as an isocyanate group reacting with an acid group or a hydroxyl group is introduced to a terminal, and an active hydrogen compound is used.

As the modified polyester resin, a urea-modified polyester resin is particularly preferable. The content of the urea-modified polyester resin is preferably from 10% by weight to 30% by weight and more preferably from 15% by weight to 25% by weight with respect to the binder resin.

As the urea-modified polyester resin, a urea-modified polyester resin obtained by a reaction (at least one reaction of a crosslinking reaction and an extension reaction) between a polyester resin (polyester prepolymer) including an isocyanate group and an amine compound is preferable. The urea-modified polyester resin may contain a urea bond and an urethane bond.

As a polyester prepolymer including an isocyanate group, a prepolymer obtained by allowing a reaction of a polyvalent isocyanate compound with respect to polyester which is a polycondensate of polyvalent carboxylic acid and polyol and includes active hydrogen is used. Examples of a group including active hydrogen included in polyester include a hydroxyl group (alcoholic hydroxyl group and phenolic hydroxyl group), an amino group, a carboxyl group, and a mercapto group, and an alcoholic hydroxyl group is preferable.

As polyvalent carboxylic acid and polyol of the polyester prepolymer including an isocyanate group, the compounds same as polyvalent carboxylic acid and polyol described in the section of the polyester resin are used.

Examples of a polyvalent isocyanate compound include aliphatic polyisocyanate (tetramethylene diisocyanate, hexamethylene diisocyanate, or 2,6-diisocyanato methyl caproate); alicyclic polyisocyanate (isophorone diisocyanate or cyclohexylmethane diisocyanate); aromatic diisocyanate (tolylene diisocyanate or diphenylmethane diisocyanate); aromatic aliphatic diisocyanate (α,α,α',α'-tetramethylxylylene diisocyanate); isocyanurates; and a component obtained by blocking the polyisocyanate by a blocking agent such as a phenol derivative, oxime, or caprolactam.

The polyvalent isocyanate compounds may be used alone or in combination of two or more kinds thereof.

A ratio of the polyvalent isocyanate compound is preferably from 1/1 to 5/1, more preferably from 1.2/1 to 4/1, and even more preferably from 1.5/1 to 2.5/1, as an equivalent ratio [NCO]/[OH] of an isocyanate group [NCO] and a hydroxyl group of a polyester prepolymer including a hydroxyl group [OH]. When the ratio [NCO]/[OH] is equal to or smaller than 5, a decrease in low temperature fixability is easily prevented.

With respect to the polyester prepolymer including an isocyanate group, the content of a component derived from the polyvalent isocyanate compound is preferably from 0.5% by weight to 40% by weight, more preferably from 1% by weight to 30% by weight, and even more preferably from 2% by weight to 20% by weight, with respect to the polyester prepolymer including an isocyanate group. When the content of a component derived from the polyvalent isocyanate is equal to or smaller than 40% by weight, a decrease in low temperature fixability is easily prevented.

The number of isocyanate groups contained per 1 molecule of the polyester prepolymer including an isocyanate group is preferably averagely equal to or greater than 1, more preferably averagely from 1.5 to 3, and even more preferably averagely from 1.8 to 2.5. When the number of isocyanate groups is equal to or greater than 1 per 1 molecule, the molecular weight of the urea-modified polyester resin after the reaction increases.

Examples of the amine compound to be reacted with the polyester prepolymer including an isocyanate group include diamine, tri- or higher valent polyamine, amino alcohol, amino mercaptan, amino acid, and a compound obtained by blocking these amino groups.

Examples of diamine include aromatic diamine (phenylene diamine, diethyl toluene diamine, or 4,4'-diaminodiphenylmethane); alicyclic diamine (4,4'-diamino-3,3'-dimethyl dicyclohexyl methane, diamine cyclohexane, or isophorone diamine); and aliphatic diamine (ethylenediamine, tetramethylenediamine, or hexamethylenediamine).

Examples of tri- or higher valent polyamine include diethylenetriamine and triethylenetetramine.

Examples of amino alcohol include ethanolamine and hydroxyethyl aniline.

Examples of amino mercaptan include aminoethyl mercaptan and aminopropyl mercaptan.

Examples of amino acid include aminopropionic acid and aminocaproic acid.

Examples of a compound obtained by blocking these amino groups include a ketimine compound and an oxazoline compound obtained from an amine compound such as diamine, tri- or higher valent polyamine, amino alcohol, amino mercaptan, or amino acid and a ketone compound (acetone, methyl ethyl ketone, or methyl isobutyl ketone).

Among these amino compounds, a ketimine compound is preferable.

The amino compounds may be used alone or in combination of two or more kinds thereof.

The urea-modified polyester resin may be a resin in which the molecular weight after the reaction is adjusted by adjusting a reaction between the polyester resin including an isocyanate group (polyester prepolymer) and an amine compound (at least one reaction of the crosslinking reaction and the extension reaction), using a stopper which stops at least one reaction of the crosslinking reaction and the extension reaction (hereinafter, also referred to as a "crosslinking/extension reaction stopper").

Examples of the crosslinking/extension reaction stopper include monoamine (diethylamine, dibutylamine, butylamine, or laurylamine) and a component obtained by blocking those (ketimine compound).

A ratio of the amine compound is preferably from 1/2 to 2/1, more preferably from 1/1.5 to 1.5/1, and even more preferably from 1/1.2 to 1.2/1, as an equivalent ratio [NCO]/[NHx] of an isocyanate group [NCO] of the polyester prepolymer including an isocyanate group and an amino group [NHx] of amines. When the ratio [NCO]/[NHx] is in the range described above, the molecular weight of the urea-modified polyester resin after the reaction increases.

A glass transition temperature of the urea-modified polyester resin is preferably from 40° C. to 65° C. and more preferably from 45° C. to 60° C. A number average molecular weight is preferably from 2,500 to 50,000 and more preferably from 2,500 to 30,000. A weight average molecular weight is preferably from 10,000 to 500,000 and more preferably from 30,000 to 100,000.

The content of the binder resin is, for example, preferably from 40% by weight to 95% by weight, more preferably from 50% by weight to 90% by weight, and even more preferably from 60% by weight to 85% by weight with respect to the total amount of the toner particles.

Release Agent

Examples of the release agent include, hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

Further, the melting temperature is determined from a DSC curve obtained by differential scanning calorimetry (DSC), using the "melting peak temperature" described in the method of determining a melting temperature in the "Testing Methods for Transition Temperatures of Plastics" in JIS K-7121-1987.

The content of the release agent is, for example, preferably from 1% by weight to 20% by weight and more preferably from 5% by weight to 15% by weight with respect to the total amount of the toner particles.

Other Additives

Examples of other additives include known additives such as a magnetic material, a charge-controlling agent, and an inorganic powder. These additives are included as internal additives in the toner particles.

Characteristics of Toner Particles

The toner particles may be toner particles having a single-layer structure, or toner particles having a so-called core/shell structure composed of a core (core particle) and a coating layer (shell layer) coated on the core.

Herein, toner particles having a core/shell structure is preferably composed of, for example, a core containing a binder resin, if necessary, other additives such as a colorant and a release agent, and a coating layer containing a binder resin.

The volume average particle diameter (D50v) of the toner particles is preferably from 2 μm to 10 μm, and more preferably from 4 μm to 8 μm.

Various average particle diameters and various particle diameter distribution indices of the toner particles are measured using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle diameter distribution of particles having a particle diameter of 2 μm to 60 μm is measured by a COULTER MULTISIZER II using an aperture having an aperture size of 100 μm. 50,000 particles are sampled.

Cumulative distributions by volume and by number are drawn from the side of the smallest diameter with respect to particle diameter ranges (channels) separated based on the measured particle diameter distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle diameter distribution index (GSDv) is calculated as $(D84v/D16v)^{1/2}$, while a number average particle diameter distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

$$SF1=(ML^2/A)\times(\pi/4)\times 100 \quad \text{Expression:}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the foregoing expression, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive are preferably treated with a hydrophobizing agent. The treatment with a hydrophobizing agent is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, polymethyl methacrylate (PMMA), and melamine resin particles) and a cleaning aid (e.g., metal salt of higher fatty acid represented by zinc stearate, and fluorine polymer particles).

The amount of the external additive externally added is, for example, preferably from 0.01% by weight to 5% by weight, and more preferably from 0.01% by weight to 2.0% by weight with respect to the toner particles.

Toner Preparing Method

Next, a method of preparing a toner according to the exemplary embodiment will be described.

The toner according to the exemplary embodiment is obtained by externally adding an external additive to toner particles after preparing of the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles are preferably obtained by an aggregation and coalescence method.

Aggregation and Coalescence Method

Specifically, for example, in a case where the toner particles are prepared by an aggregation and coalescence method, the toner particles are prepared through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process).

Hereinafter, the respective processes will be described in detail.

In the following description, a method of obtaining toner particles containing a colorant and a release agent will be described, but the colorant and the release agent are only used if necessary. Additives other than the colorant and the release agent may also be used.

Resin Particle Dispersion Preparation Process

First, for example, a colorant particle dispersion in which colorant particles containing at least the specific cyano pigment are dispersed and a release agent particle dispersion in which release agent particles are dispersed are prepared together with a resin particle dispersion in which resin particles as a binder resin are dispersed.

Herein, the resin particle dispersion is prepared by, for example, dispersing resin particles by a surfactant in a dispersion medium.

Examples of the dispersion medium used for the resin particle dispersion include aqueous mediums.

Examples of the aqueous mediums include water such as distilled water and ion exchange water, and alcohols. These may be used alone or in combination of two or more kinds thereof.

Examples of the surfactant include anionic surfactants such as sulfuric ester salt, sulfonate, phosphate, and soap anionic surfactants; cationic surfactants such as amine salt and quaternary ammonium salt cationic surfactants; and nonionic surfactants such as polyethylene glycol, ethylene oxide adduct of alkyl phenol, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO MILL having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entirety of the particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the colorant particle dispersion and the release agent dispersion are mixed together with the resin particle dispersion.

The addition of the specific benzonitrile compound is not particularly limited, and the specific benzonitrile compound may be added at the time of mixing of each dispersion described above. An additive amount thereof may be adjusted so that the content of the specific benzonitrile compound in the toner particles is in the range described above.

The resin particles, the colorant particles, the release agent particles, and the specific benzonitrile compound are heterogeneously aggregated in the mixed dispersion, thereby forming aggregated particles having a diameter near a target toner particle diameter and including the resin particles, the colorant particles, the release agent particles, and the specific benzonitrile compound.

Specifically, for example, an aggregating agent is added to the mixed dispersion and a pH of the mixed dispersion is adjusted to acidity (for example, the pH is from 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to a temperature 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the mixed dispersion using a rotary shearing-type homogenizer, the pH of the mixed dispersion may be adjusted to acidity (for example, the pH is from 2 to 5), a dispersion stabilizer may be added if necessary, and the heating may then be performed.

Examples of the aggregating agent include a surfactant having an opposite polarity to the polarity of the surfactant used as the dispersing agent to be added to the mixed dispersion, inorganic metal salts, and di- or higher-valent metal complexes. Particularly, in a case where a metal complex is used as the aggregating agent, the amount of the surfactant used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably from 0.01 parts by weight to 5.0 parts by weight, and more preferably from 0.1 parts by weight to less than 3.0 parts by weight with respect to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

After the aggregated particle dispersion in which the aggregated particles are dispersed is obtained, toner particles may be prepared through the processes of: further mixing the resin particle dispersion in which the resin particles are dispersed with the aggregated particle dispersion to conduct aggregation so that the resin particles further adhere to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

After the coalescence process ends, the toner particles formed in the solution are subjected to a washing process, a solid-liquid separation process, and a drying process, that are well known, and thus dry toner particles are obtained.

In the washing process, displacement washing using ion exchange water may be sufficiently performed from the viewpoint of charging properties. In addition, the solid-liquid separation process is not particularly limited, but suction filtration, pressure filtration, or the like may be performed from the viewpoint of productivity. The method for the drying process is also not particularly limited, but freeze drying, flash jet drying, fluidized drying, vibration-type fluidized drying, or the like may be performed from the viewpoint of productivity.

Dissolution And Suspension Method

In a case of preparing toner particles containing the urea-modified polyester resin as the binder resin, the toner particles may be obtained by the following dissolution and suspension method. In the following description regarding the dissolution and suspension method, a method of obtaining toner particles containing a release agent will be described, but the release agent is contained in the toner particles, if necessary. In addition, a method of obtaining toner particles containing the unmodified polyester resin and the urea-modified polyester resin as the binder resin will be described, but the toner particles may contain only the urea-modified polyester resin as the binder resin.

Oil-Phase Solution Preparation Process

An oil-phase solution obtained by dissolving or dispersing a toner particle material containing the unmodified polyester resin, the polyester prepolymer including an isocyanate group, the amine compound, a colorant containing at least the specific cyano pigment, the specific benzonitrile compound, and the release agent is dissolved or dispersed in an organic solvent is prepared (oil-phase solution preparation process). This oil-phase solution preparation process is a step of dissolving or dispersing the toner particle material in an organic solvent to obtain a mixed solution of the toner material.

The oil-phase solution is prepared by methods such as 1) a method of preparing an oil-phase solution by collectively dissolving or dispersing the toner material in an organic solvent, 2) a method of preparing an oil-phase solution by kneading the toner material in advance and dissolving or dispersing the kneaded material in an organic solvent, 3) a method of preparing an oil-phase solution by dissolving the unmodified polyester resin, the polyester prepolymer including an isocyanate group, and the amine compound in an organic solvent and dispersing a colorant containing the specific cyano pigment, the specific benzonitrile compound, and the release agent in the organic solvent, 4) a method of preparing an oil-phase solution by dispersing a colorant containing the specific cyano pigment, the specific benzonitrile compound, and the release agent in an organic solvent and dissolving the unmodified polyester resin, the polyester prepolymer including an isocyanate group, and the amine compound in the organic solvent, 5) a method of preparing an oil-phase solution by dissolving or dispersing toner particle materials other than the polyester prepolymer including an isocyanate group and the amine compound (the unmodified polyester resin, a colorant containing the specific cyano pigment, the specific benzonitrile compound, and the release agent) in an organic solvent and dissolving the polyester prepolymer including an isocyanate group and the amine compound in the organic solvent, 6) a method of preparing an oil-phase solution by dissolving or dispersing toner particle materials other than the polyester prepolymer including an isocyanate group or the amine compound (the unmodified polyester resin, a colorant containing the specific cyano pigment, the specific benzonitrile compound, and the release agent) in an organic solvent and dissolving the polyester prepolymer including an isocyanate group or the amine compound in the organic solvent. The method of preparing the oil-phase solution is not limited thereto.

Examples of the organic solvent of the oil-phase solution include an ester solvent such as methyl acetate or ethyl acetate; a ketone solvent such as methyl ethyl ketone or methyl isopropyl ketone; an aliphatic hydrocarbon solvent such as hexane or cyclohexane; a halogenated hydrocarbon solvent such as dichloromethane, chloroform or trichloroethylene. It is preferable that these organic solvents dissolve the binder resin, a rate of the organic solvent dissolving in water is from approximately 0%, by weight to 30% by weight, and a boiling point is equal to or lower than 100° C. Among the organic solvents, ethyl acetate is preferable.

Suspension Preparation Process

Next, a suspension is prepared by dispersing the obtained oil-phase solution in a water-phase solution (suspension preparation process). A reaction between the polyester prepolymer including an isocyanate group and the amine compound is performed together with the preparation of the suspension. The urea-modified polyester resin is formed by the reaction. The reaction is performed with at least one reaction of the crosslinking reaction and the extension reaction of molecular chains. The reaction between the polyester prepolymer including an isocyanate group and the amine compound may be performed with the following organic solvent removing process.

Herein, the reaction conditions are selected according to reactivity between the structure of isocyanate group included in the polyester prepolymer and the amine compound. As an example, a reaction time is preferably from 10 minutes to 40 hours and more preferably from 2 hours to 24 hours. A reaction temperature is preferably from 0° C. to 150° C. and more preferably from 40° C. to 98° C. In addition, a well-known catalyst (dibutyltin laurate or dioctyl tin laurate) may be used if necessary, in the formation of the urea-modified polyester resin. That is, a catalyst may be added to the oil-phase solution or the suspension.

As the water-phase solution, a water-phase solution obtained by dispersing a particle dispersing agent such as an organic particle dispersing agent or an inorganic particle dispersing agent in an aqueous solvent is used. In addition, as the water-phase solution, a water-phase solution obtained by dispersing a particle dispersing agent in an aqueous solvent and dissolving a polymer dispersing agent in an aqueous solvent is also used. Further, a well-known additive such as a surfactant may be added to the water-phase solution.

As the aqueous solvent, water (for example, generally ion exchange water, distilled water, or pure water) is used. The aqueous solvent may be a solvent containing water and an organic solvent such as alcohol (methanol, isopropyl alcohol, or ethylene glycol), dimethylformamide, tetrahydrofuran, cellosolves (methyl cellosolve), or lower ketones (acetone or methyl ethyl ketone).

As the organic particle dispersing agent, a hydrophilic organic particle dispersing agent is used. As the organic particle dispersing agent, particles of poly(meth) acrylic acid alkyl ester resin (for example, a polymethyl methacrylate resin), a polystyrene resin, or a poly (styrene-acrylonitrile) resin are used. As the organic particle dispersing agent, particles of a styrene acrylic resin are also used.

As the inorganic particle dispersing agent, a hydrophilic inorganic particle dispersing agent is used. Specific examples of the inorganic particle dispersing agent include particles of silica, alumina, titania, calcium carbonate, magnesium carbonate, tricalcium phosphate, clay, diatomaceous earth, or bentonite, and particles of calcium carbonate are preferable. The inorganic particle dispersing agent may be used alone or in combination of two or more kinds thereof.

The surface of the particle dispersing agent may be subjected to surface treatment by a polymer including a carboxyl group.

As the polymer including a carboxyl group, a copolymer of at least one kind selected from salts (alkali metal salt, alkaline earth metal salt, ammonium salt, amine salt) in which α,β-monoethylenically unsaturated carboxylic acid or a carboxyl group of α,β-monoethylenically unsaturated carboxylic acid is neutralized by alkali metal, alkaline earth metal, ammonium, or amine, and α,β-monoethylenically unsaturated carboxylic acid ester is used. As the polymer including a carboxyl group, salt (alkali metal salt, alkaline earth metal salt, ammonium salt, amine salt) in which a carboxyl group of a copolymer of α,β-monoethylenically unsaturated carboxylic acid and α,β-monoethylenically unsaturated carboxylic acid ester is neutralized by alkali metal, alkaline earth metal, ammonium, or amine is also used. The polymer including a carboxyl group may be used alone or in combination with two or more kinds thereof.

Representative examples of α,β-monoethylenically unsaturated carboxylic acid include α,β-unsaturated monocarboxylic acid (acrylic acid, methacrylic acid, or crotonic acid), and α,β-unsaturated dicarboxylic acids (maleic acid, fumaric acid, or itaconic acid). Representative examples of α,β-monoethylenically unsaturated carboxylic acid ester include alkyl esters of (meth)acrylate, (meth)acrylate including an alkoxy group, (meth)acrylate including a cyclohexyl group, (meth)acrylate including a hydroxy group, and polyalkylene glycol mono(meth) acrylate.

As the polymer dispersing agent, a hydrophilic polymer dispersing agent is used. As the polymer dispersing agent, specifically a polymer dispersing agent which includes a carboxyl group and does not include lipophilic group (hydroxypropoxy group or a methoxy group) (for example, water-soluble cellulose ether such as carboxymethyl cellulose or carboxyethyl cellulose) is used.

Solvent Removing Process

Next, a toner particle dispersion is obtained by removing an organic solvent from the obtained suspension (solvent removing process). The solvent removing process is a process of forming toner particles by removing the organic solvent contained in liquid droplets of the water-phase solution dispersed in the suspension. The method of removing the solvent from the suspension may be performed immediately after the suspension preparation process or may be performed after 1 minute or longer, after the suspension preparation process.

In the solvent removing process, the organic solvent may be removed from the suspension by cooling or heating the obtained suspension to have a temperature in a range of 0° C. to 100° C., for example.

As a specific method of the organic solvent removing method, the following method is used.

(1) A method of allowing airflow to blow to the suspension to forcibly update a gas phase on the surface of the suspension. In this case, gas may flow into the suspension.

(2) A method of reducing pressure. In this case, a gas phase on the surface of the suspension may be forcibly updated due to filling of gas or gas may further blow into the suspension.

The toner particles are obtained through the above-mentioned processes.

Herein, after the organic solvent removing process ends, the toner particles formed in the toner particle dispersion are subjected to a well-known washing process, a well-known solid-liquid separation process, a well-known drying process, and thereby dried toner particles are obtained.

Regarding the washing process, replacing washing using ion exchanged water may preferably be sufficiently performed for charging property.

The solid-liquid separation process is not particularly limited, but suction filtration, pressure filtration, or the like may preferably be performed for productivity. The drying process is not particularly limited, but freeze drying, flash jet drying, fluidized drying, vibrating fluidized drying, and the like may preferably be performed for productivity.

The toner according to the exemplary embodiment is prepared, for example, by adding an external additive to the obtained toner particles in a dried state, and performing mixing. The mixing may be performed, for example, by using a V blender, a HENSCHEL mixer, a LÖDIGE MIXER, or the like. Furthermore, if necessary, coarse toner particles may be removed using a vibration sieving machine, a wind classifier, or the like.

Electrostatic Charge Image Developer

An electrostatic charge image developer according to the exemplary embodiment includes at least the toner according to the exemplary embodiment.

The electrostatic charge image developer according to the exemplary embodiment may be a single-component developer including only the toner according to the exemplary embodiment, or a two-component developer obtained by mixing the toner with a carrier.

The carrier is not particularly limited, and known carriers are exemplified. Examples of the carrier include a coated carrier in which surfaces of cores formed of a magnetic particle are coated with a coating resin; a magnetic particle dispersion-type carrier in which a magnetic particle is dispersed and blended in a matrix resin; and a resin impregnation-type carrier in which a porous magnetic particle is impregnated with a resin.

The magnetic particle dispersion-type carrier and the resin impregnation-type carrier may be carriers in which constituent particles of the carrier are cores and coated with a coating resin.

Examples of the magnetic particle include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as conductive particles.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved or dispersed in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to the exemplary embodiment will be described.

The image forming apparatus according to the exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to the exemplary embodiment is applied.

In the image forming apparatus according to the exemplary embodiment, an image forming method (image forming method according to the exemplary embodiment) including a charging process of charging a surface of an image holding member, an electrostatic charge image forming process of forming an electrostatic charge image on a charged surface of the image holding member, a developing process of developing the electrostatic charge image formed on the surface of the image holding member with the electrostatic charge image developer according to the exemplary embodiment to form a toner image, a transfer process of transferring the toner image formed on the surface of the image holding member onto a surface of a recording medium, and a fixing process of fixing the toner image transferred onto the surface of the recording medium is performed.

As the image forming apparatus according to the exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case of an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to the exemplary embodiment, for example, a part including the developing unit may have a cartridge structure (process cartridge) that is detachable from the image forming apparatus. As the process cartridge, for example, a process cartridge that contains the electrostatic charge image developer according to the exemplary embodiment and is provided with a developing unit is preferably used.

Hereinafter, an example of the image forming apparatus according to the exemplary embodiment will be shown. However, the image forming apparatus is not limited thereto. Major parts shown in the drawing will be described, but descriptions of other parts will be omitted.

FIG. 1 is a schematic diagram showing a configuration of the image forming apparatus according to the exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner contained in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative electrostatic charge image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, whereby the electrostatic charge image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K, of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to the exemplary embodiment will be described.

The process cartridge according to the exemplary embodiment is provided with a developing unit that contains the electrostatic charge image developer according to the exemplary embodiment and develops an electrostatic charge image formed on a surface of an image holding member with the electrostatic charge image developer to form a toner image, and is detachable from an image forming apparatus.

The process cartridge according to the exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to the exemplary embodiment will be shown. However, this process cartridge is not limited thereto. Major parts shown in the drawing will be described, but descriptions of other parts will be omitted.

Figure 2:
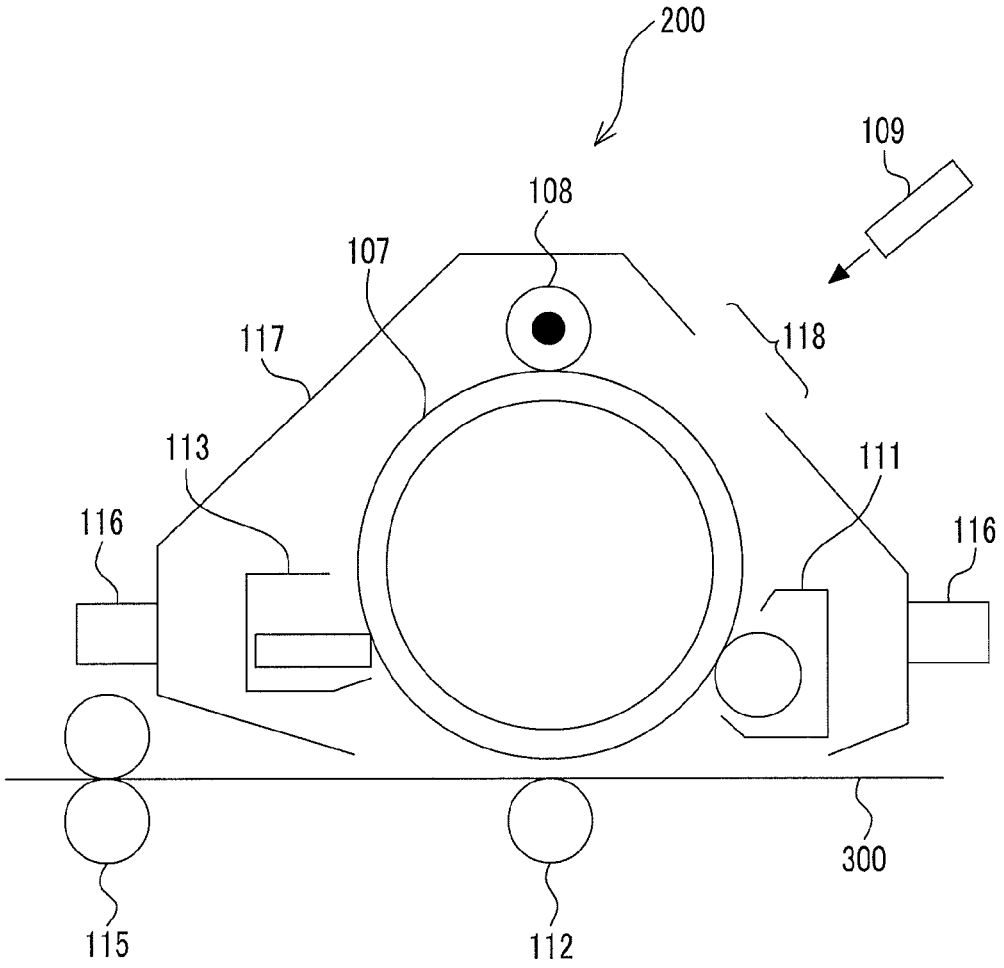
FIG. 2 is a schematic configuration diagram showing an example of a process cartridge according to the exemplary embodiment.

FIG. 2 is a schematic diagram showing a configuration of the process cartridge according to the exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to the exemplary embodiment will be described.

The toner cartridge according to the exemplary embodiment contains the toner according to the exemplary embodiment and is detachable from an image forming apparatus. The toner cartridge contains a toner for replenishment for being supplied to the developing unit provided in the image forming apparatus. The toner cartridge may have a container which contains the toner according to the exemplary embodiment.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, in a case where the toner contained in the toner cartridge runs low, the toner cartridge is replaced.

EXAMPLES

Hereinafter, the exemplary embodiment will be described in detail using examples but the exemplary embodiment is not limited to the examples. In the following description, "parts" and "%," are based on weight, unless specifically noted.

Example 1

Preparation of Resin Particle Dispersion

Resin Particle Dispersion (1)

Terephthalic acid: 30 parts by mol

Fumaric acid: 70 parts by mol

Ethylene oxide adduct of bisphenol A: 5 parts by mol

Propylene oxide adduct of bisphenol A: 95 parts by mol

The above materials are added in a 5-liter flask equipped with a stirrer, a nitrogen gas introducing tube, a temperature sensor, and a rectifying column, the temperature is increased to 220° C. for 1 hour, and 1 part of titanium tetraethoxide is added to 100 parts of the above material. The temperature is increased to 230° C. for 0.5 hours while distilling away generated water, a dehydration condensation reaction is continued at this temperature for 1 hour, and then the reactant is cooled. Thus, a polyester resin (1) having a weight average molecular weight of 18,000, an acid value of 15 mgKOH/g, and a glass transition temperature of 60° C. is synthesized. 40 parts of ethyl acetate and 25 parts of 2-butanol are added to a vessel equipped with a temperature adjustment unit and a nitrogen substitution unit to set a mixed solution, 100 parts of the polyester resin (1) is slowly added and dissolved in the mixed solvent, and 10% ammonia aqueous solution (equivalent to the amount of three times the acid value of the resin by a molar ratio) is added thereto and stirred for 30 minutes. Then, the atmosphere in the vessel is substituted with dry nitrogen, the temperature is maintained at 40° C., and 400 parts of ion exchange water is added thereto dropwise at a rate of 2 part/min, while stirring the mixed solution, to perform emulsification. After performing dropwise adding, the temperature of the emulsified solution is returned to room temperature (20° C. to 25° C.), bubbling is performed for 48 hours by dry nitrogen while stirring, to decrease the content of ethyl acetate and 2-butanol to be equal to or smaller than 1,000 ppm, and thus, a resin particle dispersion in which resin particles having a volume average particle diameter of 200 nm are dispersed is obtained. Ion exchange water is added to the resin particle dispersion to adjust the solid component amount to 20% by weight and thus, a resin particle dispersion (1) is obtained.

Preparation of Colorant Particle Dispersion

Colorant Particle Dispersion (1)

Specific cyano pigment (C.I. Pigment Yellow 185, manufactured by BASF SE, PALIOTOL YELLOW D1155): 70 parts Anionic surfactant (NEOGEN RK manufactured by DKS Co., Ltd.): 30 parts Ion exchange water: 200 parts The above materials are mixed and dispersed using a homogenizer (ULTRA TURRAX T50 manufactured by IKA Works, Inc.) for 10 minutes. Ion exchange water is added to the dispersion so that the solid component amount becomes 20% by weight and thus, a colorant particle dispersion (1) in which colorant particles (specific cyano pigment) having a volume average particle diameter of 140 nm are dispersed is obtained.

Preparation of Release Agent Particle Dispersion

Release Agent Particle Dispersion (1)

Paraffin Wax (HNP-9 manufactured by Nippon Seiro Co., Ltd.): 100 parts

Anionic surfactant (NEOGEN RK manufactured by DKS Co., Ltd.): 1 part

Ion exchange water: 350 parts

The above materials are mixed, heated to 100° C., and dispersed using a homogenizer (ULTRA TURRAX T50 manufactured by IKA Works, Inc.). After that, the mixture is subject to dispersion treatment with MANTON-GAULIN HIGH PRESSURE HOMOGENIZER (manufactured by Gaulin Co., Ltd.), and thus, a release agent particle dispersion (1) (solid component amount: 20% by weight) in which release agent particles having a volume average particle diameter of 200 nm are dispersed is obtained.

Preparation of Toner Particles

Resin particle dispersion (1): 405 parts

Colorant particle dispersion (1): 40 parts

Release agent particle dispersion (1): 50 parts phthalonitrile (specific benzonitrile compound): 0.020 parts Anionic surfactant (TAYCAPOWER manufactured by TAYCA): 2 parts The above materials are put into the round stainless steel flask, 0.1 N of nitric acid is added to adjust the pH to 3.5, and then, 30 parts of a nitric acid aqueous solution having polyaluminum chloride concentration of 10% is added. Then, the resultant material is dispersed at 30° C. using a homogenizer (ULTRA TURRAX T50 manufactured by IKA Works, Inc.) and heated to 45° C. in a heating oil bath and maintained for 30 minutes. After that, 100 parts of the resin particle dispersion (1) are gently added thereto and maintained for 1 hour. After adjusting the pH to 8.5 by adding 0.1 N sodium hydroxide aqueous solution, the temperature is increased to 85° C. while continuing the stirring, and maintained for 5 hours. Then, the temperature is decreased to 20° C. at a rate of 20° C./min, the resultant material is filtered, sufficiently washed with ion exchange water, and dried, to thereby obtain toner particles (1) having a volume average particle diameter of 7.5 μm.

Preparation of Toner 100 parts of the toner particles (1) and 0.7 parts of dimethyl silicone oil-treated silica particles (RY 200 manufactured by Nippon Aerosil co., Ltd.) are mixed in a HENSCHEL mixer to thereby obtain a toner (1).

The amount of phthalonitrile in the toner particles (1) is 200 ppm.

Preparation of Developer

Ferrite particles (average particle diameter: 50 μm): 100 parts

Toluene: 14 parts

Styrene-methyl methacrylate copolymer (copolymerization ratio: 15/85): 3 parts

Carbon black: 0.2 parts

The above components excluding the ferrite particles are dispersed by a sand mill to prepare dispersion, this dispersion and the ferrite particles are put into a vacuum degassing type kneader, and dried while stirring under the reduced pressure, thereby obtaining a carrier.

8 parts of the toner (1) is mixed with 100 parts of the carrier to thereby obtain a developer (1).

Example 2

Toner particles are prepared in the same manner as in Example 1 except for changing the additive amount of phthalonitrile so that the amount thereof in the toner particles is 10 ppm, and a developer is obtained in the same manner as in Example 1 except for using the toner particles.

Example 3

Toner particles are prepared in the same manner as in Example 1 except for changing the additive amount of phthalonitrile so that the amount thereof in the toner particles is 500 ppm, and a developer is obtained in the same manner as in Example 1 except for using the toner particles.

Example 4

Toner particles are prepared in the same manner as in Example 1 except for using benzonitrile instead of phthalonitrile, and a developer is obtained in the same manner as in Example 1 except for using the toner particles.

Example 5

Toner particles are prepared in the same manner as in Example 1 except for using C.I. Pigment Orange 71 manufactured by BASF SE, CROMOPHTAL DPP ORANGE TR, instead of C.I. Pigment Yellow 185 as a pigment, and a developer is obtained in the same manner as in Example 1 except for using the toner particles.

Example 6

Toner particles are prepared by the dissolution and suspension method using the urea-modified polyester resin as the binder resin.

Preparation of Unmodified Polyester Resin (6)

Terephthalic acid: 1243 parts

Ethylene oxide adduct of bisphenol A: 1830 parts

Propylene oxide adduct of bisphenol A: 840 parts

The above components are mixed and heated at 180° C., 3 parts of dibutyltin oxide is added thereto, and water is distilled away while heating at 220° C. to thereby obtain a polyester resin. 1500 parts of cyclohexanone is added to the obtained polyester to dissolve the polyester resin, and 250 parts of acetic anhydride is added to the cyclohexanone solution and heated at 130° C. The solution is heated under reduced pressure to remove the solvent and the unreacted acid, thereby obtaining an unmodified polyester resin. Regarding the obtained unmodified polyester resin, a glass transition temperature Tg is 60° C., an acid value is 3 mgKOH/g, and a hydroxyl value is 1 mgKOH/g.

Preparation of Polyester Prepolymer (6)

Terephthalic acid: 1243 parts

Ethylene oxide adduct of bisphenol A: 1830 parts

Propylene oxide adduct of bisphenol A: 840 parts

The above components are mixed and heated at 180° C., 3 parts of dibutyltin oxide is added thereto, and water is distilled away while heating at 220° C. to thereby obtain a polyester prepolymer. 350 parts of the obtained polyester prepolymer, 50 parts of tolylenediisocyanate, and 450 parts of ethyl acetate are put into a vessel and a mixture thereof is heated at 130° C. for 3 hours to thereby obtain a polyester prepolymer including an isocyanate group (isocyanate-modified polyester prepolymer (6)).

Preparation of Ketimine Compound (6)

50 parts of methyl ethyl ketone and 150 parts of hexamethylene diamine are put into a vessel and stirred at 60° C. to obtain a ketimine compound (6).

Preparation of pigment dispersion (6)

Specific cyano pigment (C.I. Pigment Yellow 185, manufactured by BASF SE, PALIOTOL YELLOW D1155): 100 parts Ethyl acetate: 500 parts After mixing the components described above and repeating an operation of filtering the mixture and further mixing the resultant filtrate with 500 parts of ethyl acetate 5 times, the solution is dispersed using an emulsion dispersing machine CAVITRON (CR 1010 manufactured by Pacific Machinery & Engineering Co., Ltd.) for approximately 1 hour to thereby obtain a pigment dispersion (6) in which a pigment (specific cyano pigment) is dispersed (solid content concentration: 10%).

Preparation of release agent dispersion (6)

Paraffin Wax (melting temperature: 89° C.): 30 parts

Ethyl acetate: 270 parts

The above components are subjected to wet pulverization by a micro beads dispersing machine (DCP mill) in a state of being cooled to 10° C. to thereby obtain a release agent dispersion (6).

Preparation of Oil-Phase Solution (6)

Unmodified polyester resin (6): 127 parts

Pigment dispersion (6): 330 parts

Ethyl acetate: 56 parts

Phthalonitrile (specific benzonitrile compound): 0.08 parts

After stirring and mixing the above components, 400 parts of the release agent dispersion (6) is added to the obtained mixture, and the mixture is stirred to thereby obtain an oil-phase solution (6).

Preparation of Styrene Acrylic Resin Particle Dispersion (6)

Styrene: 370 parts n-Butyl acrylate: 30 parts

Acrylic acid: 4 parts

Dodecanethiol: 24 parts

Carbon tetrabromide: 4 parts

The above components are mixed, the dissolved mixture is dispersed and emulsified in a water-soluble solution obtained by dissolving 6 parts of a nonionic surfactant (NONIPOL 400 manufactured by Sanyo Chemical Industries, Ltd.) and 10 parts of an anionic surfactant (NEOGEN SC manufactured by DKS Co., Ltd.) in 560 parts of ion exchange water, in a flask, an aqueous solution obtained by dissolving 4 parts of ammonium persulfate in 50 parts of ion exchange water is added thereto while mixing over 10 minutes, nitrogen substitution is performed, then, the heating is performed in an oil bath until the temperature of the content becomes 70° C. while stirring the materials in the flask, and thus, emulsification and polymerization are performed for 5 hours. Thus, a styrene acrylic resin particle dispersion (6) in which resin particles having an average particle diameter of 180 nm and a weight average molecular weight (Mw) of 15,500 are dispersed (resin particle concentration: 40% by weight) is obtained. A glass transition temperature of the styrene acrylic resin particles is 59° C.

Preparation of Water-Phase Solution (6)

Styrene acrylic resin particle dispersion (6): 100 parts

2% Water-soluble solution of SEROGEN ES-H (manufactured by DKS Co., Ltd.): 200 parts Ion exchange water: 200 parts The above components are stirred and mixed with each other to obtain a water-phase solution (6).

Preparation of Toner Particles

Oil-phase solution (6): 300 parts

Isocyanate-modified polyester prepolymer (6): 25 parts

Ketimine compound (6): 0.5 parts

After putting the above components in a vessel and stirring the components using a homogenizer (ULTRA TURRAX manufactured by IKA Works, Inc.) for 2 minutes to obtain an oil-phase solution (1P), 500 parts of water-phase solution (6) is added to the vessel and stirred using a homogenizer for 20 minutes. Then, the mixed solution is stirred using a propeller-attached stirrer at room temperature (25° C.) under ordinary pressure (1 atmospheric pressure) for 48 hours, a reaction between isocyanate-modified polyester prepolymer (6) and the ketimine compound (6) is allowed to form a urea-modified polyester resin, the organic solvent is removed, and particulates are formed. Next, the particulates are washed, dried, and classified, to thereby obtain toner particles (6). A volume average particle diameter of the toner particles is 7.5 μm.

Preparation of Toner (6)

100 parts of the toner particles (6) and 0.7 parts of dimethyl silicone oil-treated silica particles (RY200 manufactured by Nippon Aerosil co., ltd.) are mixed in a HENSCHEL mixer to thereby obtain a toner (6).

The amount of phthalonitrile in the toner particles (6) is 200 ppm.

Comparative Example 1

Toner particles are prepared in the same manner as in Example 1 except for not adding phthalonitrile, and a developer is obtained in the same manner as in Example 1 except for using the toner particles.

Comparative Example 2

Toner particles are prepared in the same manner as in Example 1 except for using C.I. Pigment Yellow 74 manufactured by Clariant, HANSA YELLOW 5GX01 (pigment not containing a cyano group (—CN) in a molecular structure), instead of C.I. Pigment Yellow 185 as the pigment, and a developer is obtained in the same manner as in Example 1 except for using the toner particles.

Comparative Example 3

Toner particles are prepared in the same manner as in Example 1 except for changing the additive amount of phthalonitrile so that the amount thereof in the toner particles is 0.8 ppm, and a developer is obtained in the same manner as in Example 1 except for using the toner particles.

Comparative Example 4

Toner particles are prepared in the same manner as in Example 1 except for changing the additive amount of phthalonitrile so that the amount thereof in the toner particles is 550 ppm, and a developer is obtained in the same manner as in Example 1 except for using the toner particles.

Evaluation

The following evaluations are performed using developers obtained in Examples. The results are shown in Table 1.

Evaluation of Image Folding Strength and Density

The following operation and image formation are performed in the environment of a temperature of 25° C. and humidity of 60%.

APEOSPORTIV C 4470 manufactured by Fuji Xerox Co., Ltd. is prepared as an image forming apparatus which forms images for evaluation, the developer is put in a developing device, and supply toner (the same toner as the toner contained in the developer) is put in a toner cartridge. Then, a 5 cm×5 cm-sized solid image having an image area ratio of 100% and a 5 cm×5 cm-sized half-tone image having an image area ratio of 50% are formed on a coated paper (JD COAT manufactured by Fuji Xerox Co., Ltd., product name JD COAT 127, bases weight 127 g/m$^2$, paper thickness: 140 μm) in yellow or orange, and 100 sheets are continuously printed. The following evaluation is performed with respect to the image on the 100th sheet obtained.

Evaluation of Image Folding Strength

An evaluation of the image folding strength is performed with respect to the 5 cm×5 cm-sized half-tone images having an image area ratio of 50% on the 100th sheet obtained. A sheet having the image formed thereon is folded, a 870 g weight is loaded on the folded portion and the folded portion is rubbed once to crease the sheet, then, the sheet is opened, the folded image portion is wiped with cotton, and an image width (μm) of a white spot (where deletion is caused) is measured. When a width of a white spot portion is equal to or smaller than 40 μm, it is determined to be in an acceptable range.

Density

An evaluation of the density is performed with respect to the 5 cm×5 cm-sized solid images having an image area ratio of 100% on the 100th sheet obtained. The density of yellow or orange images is measured using a reflection spectroscopic densitometer (product name: XRITE-939 manufactured by X-Rite, Inc.). When the density is equal to or greater than 1.4, it is determined to be in an acceptable range.

Evaluation of Transfer Properties

The following operation and image formation are performed in the environment of a temperature of 30° C. and humidity of 80%.

APEOSPORT IV C 4470 manufactured by Fuji Xerox Co., Ltd. is prepared as an image forming apparatus which forms images for evaluation, the developer is put in a developing device, and supply toner (the same toner as the toner contained in the developer) is put in a toner cartridge. Then, a 5 cm×5 cm-sized solid image having an image area ratio of 100% is formed on a pure paper (P PAPER manufactured by Fuji Xerox Co., Ltd., product name P, bases weight 64 g/m$^2$, paper thickness: 88 μm) in yellow or orange, and 100 sheets are continuously printed. Adhesive tape is attached and separated to and from a transferring residual image remaining on a photoreceptor of 100th sheet, to transfer the image to the adhesive tape, and the following evaluation is performed.

Evaluation of density is performed with respect to the image transferred to the adhesive tape. The density of the yellow or orange transferring residual image is measured using a reflection spectroscopic densitometer (product name: XRITE-939 manufactured by X-Rite, Inc.). When the density is equal to or lower than 0.10, it is determined to be in an acceptable range.

Evaluation of Pigment Dispersibility

An evaluation of transmittance PE of light in the image is performed as an index of the dispersibility of the pigment (amount of aggregates of the pigment) in the image.

Specifically, in the same manner as in the evaluation of density, a 5 cm×5 cm-sized solid image having an image area ratio of 100% is formed on an OHP sheet (FULL COLOR OHP FILM HG manufactured by Fuji Xerox Co., Ltd.), and regarding this solid image, a ratio of total light transmitted light components and straight advancing light components at each wavelength of in the visible light range is calculated by the following equation.

$$PE=\log(\Sigma[P(\lambda)+N(\lambda)]/n)/\log(\Sigma[P(\lambda)]/n)$$

P(λ) represents straight advancing light and N(λ) represents a diffused light component.

The measurement of total light transmitted light components and straight advancing light components at each wavelength of in the visible light range is performed using MATCH-SCAN manufactured by DIANO.

TABLE 1

| | | Cyano pigment | Benzonitrile compound | Amount [ppm] | Evaluation: Image folding strength | Density | Transfer properties | PE |
|---|---|---|---|---|---|---|---|---|
| Ex. | 1 | PY185 | Phthalonitrile | 200 | 25 | 1.6 | 0.05 | 66 |
| | 2 | PY185 | Phthalonitrile | 10 | 30 | 1.51 | 0.05 | 62 |
| | 3 | PY185 | Phthalonitrile | 500 | 30 | 1.5 | 0.07 | 63 |
| | 4 | PY185 | Benzonitrile | 200 | 35 | 1.45 | 0.09 | 60 |
| | 5 | P071 | Phthalonitrile | 200 | 30 | 1.62 | 0.05 | 66 |
| | 6 | PY185 | Phthalonitrile | 200 | 20 | 1. 66 | 0.03 | 68 |
| Com. Ex. | 1 | PY185 | — | 0 | 60 | 1.29 | 0.07 | 50 |
| | 2 | PY74 | Phthalonitrile | 200 | 50 | 1.35 | 0.09 | 55 |
| | 3 | PY185 | Phthalonitrile | 0.8 | 50 | 1.35 | 0.07 | 56 |
| | 4 | PY185 | Phthalonitrile | 550 | 35 | 1.25 | 0.2 | 60 |

In Table 1, "PY185" indicates C.I. Pigment Yellow 185, "PO71" indicates C.I. Pigment Orange 71, and "PY74" indicates C.I. Pigment Yellow 74.

It is found that the image folding strength is high in Examples 1 to 6 using the toner which contains the specific cyano pigment and in which the amount of specific benzonitrile compound is in a range of 1 ppm to 500 ppm with respect to the toner particles, compared to Comparative Example 1 in which the specific benzonitrile compound is not contained and Comparative Example 2 in which the specific cyano pigment is not contained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles including a binder resin, a cyano pigment containing cyano group (—CN) in a molecular structure, and a benzonitrile compound which has a structure in which at least one cyano group (—CN) is present on a benzene ring as a substituent and has a molecular weight equal to or smaller than 300, wherein a content of the benzonitrile compound is from 1 ppm to 500 ppm with respect to the total amount of the toner particles.

2. The electrostatic charge image developing toner according to claim 1, wherein the cyano pigment contains C.I. Pigment Yellow 185.

3. The electrostatic charge image developing toner according to claim 1, wherein a molecular weight of the benzonitrile compound is equal to or smaller than 150.

4. The electrostatic charge image developing toner according to claim 1, wherein the benzonitrile compound contains phthalonitrile.

5. The electrostatic charge image developing toner according to claim 1, wherein a content of the cyano pigment is from 3% by weight to 15% by weight with respect to the total amount of the toner particles.

6. The electrostatic charge image developing toner according to claim 1, wherein a content of the benzonitrile compound is from 100 ppm to 300 ppm with respect to the total amount of the toner particles.

7. The electrostatic charge image developing toner according to claim 1, wherein the binder resin is a polyester having a glass transition temperature (Tg) of 50° C. to 80° C.

8. The electrostatic charge image developing toner according to claim 1, wherein the binder resin is a polyester having a number average molecular weight (Mn) of 2,000 to 100,000.

9. The electrostatic charge image developing toner according to claim 1, wherein the binder resin contains a urea-modified polyester resin.

10. The electrostatic charge image developing toner according to claim 9, wherein a content of the urea-modified polyester resin is from 10% by weight to 30% by weight with respect to the total amount of the binder resin.

11. The electrostatic charge image developing toner according to claim 9, wherein a glass transition temperature of the urea-modified polyester resin is from 40° C. to 65° C.

12. An electrostatic charge image developer comprising:

the electrostatic charge image developing toner according to claim 1.

13. A toner cartridge comprising:

a container that contains the electrostatic charge image developing toner according to claim 1, wherein the toner cartridge is detachable from an image forming apparatus.

* * * * *